US005214861A

United States Patent [19]

Vuorinen

[11] Patent Number: 5,214,861

[45] Date of Patent: Jun. 1, 1993

[54] BLOW AND AIR-CONDITIONING DEVICE FOR AN INVERTED CYLINDER GROUP IN THE DRYING SECTION OF A PAPER MACHINE

[75] Inventor: Vesa Vuorinen, Turku, Finland

[73] Assignee: Valmet Paper Machinery Inc., Finland

[21] Appl. No.: 801,698

[22] Filed: Dec. 2, 1991

[30] Foreign Application Priority Data

Dec. 3, 1990 [FI] Finland ..... 905959

[51] Int. Cl.[5] ..... F26B 13/04

[52] U.S. Cl. ..... 34/114; 34/117

[58] Field of Search ..... 34/117, 114, 115, 113, 34/116

[56] References Cited

U.S. PATENT DOCUMENTS 5,065,529 11/1991 Skaugen et al. ..... 34/117

*Primary Examiner*—Henry A. Bennet

*Attorney, Agent, or Firm*—Steinberg & Raskin

[57] ABSTRACT

The invention is related to a blow and air-conditioning device for an inverted cylinder group in a drying section of a paper machine. The inverted cylinder group includes a lower row of drying cylinders and a corresponding row of leading cylinders or rolls placed above said cylinders in the gaps between them. The inverted cylinder group is provided with single-wire draw so that the heated drying cylinders placed in the lower row in the group, are placed outside the loop of a drying wire and the lead cylinders in the group are placed inside the drying-wire loop. A blow box is fitted in spaces between adjacent leading cylinders and above the drying cylinders. A nozzle of the blow box directs blowings into a wedge-shaped nip space opening in the direction of running of the web, which outlet nip space is defined between the face of the drying cylinder and the run of the web and of the drying wire. The blow box further includes nozzle slots or perforations which direct a set of jets at the web running over the leading cylinders in order to promote evaporation of water out of the web.

14 Claims, 3 Drawing Sheets

BLOW AND AIR-CONDITIONING DEVICE FOR AN INVERTED CYLINDER GROUP IN THE DRYING SECTION OF A PAPER MACHINE

BACKGROUND OF THE INVENTION

The present invention is related to a blow and air-conditioning device for an inverted cylinder group in the drying section of a paper machine, which inverted cylinder group comprises a lower row of drying cylinders, and placed above said cylinders in the gaps between them, a corresponding row of leading cylinders or corresponding leading rolls. The cylinder group is provided with single-wire draw so that the heated drying cylinders, placed in the lower row in the group, are outside the loop of their drying wire, and the leading cylinders in the group are placed inside the drying-wire loop.

The prior-art drying sections in paper machines comprise a number of drying cylinders, which are usually heated by steam. The paper web to be dried is pressed into direct drying contact against the drying cylinders by means of a drying wire. As is known in prior art, both twin-wire draw and single-wire draw are employed in drying sections. Recently, single-wire draw has become more common, because it gives the web to be dried constant support and a closed draw, without free draws of the web, through the whole drying section.

As a rule, such drying sections with single-wire draw are in the use in which the cylinders in the upper row are heated cylinders placed outside the loop of the drying wire, and the cylinders in the lower row are leading cylinders or rolls, which are provided with suction zones to promote the support contact of the web and the wire. When the above single-wire groups are used, in which the drying cylinders are in the upper row, several cylinders one after the other, it is a drawback that the web becomes dry one-sidedly, i.e. more quickly at the side that is in direct contact with the heated faces of the drying cylinders.

Asymmetric drying of the web produces a number of drawbacks, for which reason, recently, such multi-cylinder dryers provided with single-wire draw have become common in which so-called inverted cylinder groups are employed (i.e., the drying cylinders are placed in the lower row and the leading cylinders or rolls in the upper row).

However, in these inverted cylinder groups, a problem has consisted of the ventilation of the spaces at the drying cylinders that remain between the leading cylinders as well as of the differences in pressure, as compared with their surroundings, at the narrowing wedge-shaped spaces in connection with the free faces of the drying cylinders. In the wedge spaces that form the nip at the inlet side of the web and the wire, a positive pressure tends to be induced, and a negative pressure tends to be induced at the corresponding outlet-side nips. It is in particular said nips with negative pressure that cause drawbacks, because replacement air is sucked into them from the sides of the drying section. The air that flows in tends to penetrate between the wire and the paper and to separate the edge of the paper from the wire, which causes drawbacks, such as web breaks. The negative pressure at the outlet nips is further increased by a so-called chimney effect, i.e. by air flows that can rise out of the afore-mentioned spaces upwards without obstacles by the effect of gravity.

A further drawback in these single-wire groups concerns how to keep the spaces between the leading cylinders clean from paper broke. This drawback is caused by the fact that the intermediate spaces do not open downwards, which is the case in normal cylinder groups, but instead are limited by the upper free sector of the drying cylinder from below.

OBJECTS AND SUMMARY OF THE INVENTION

An object of the present invention is to provide novel solutions for the problems discussed above so as to eliminate the above drawbacks.

In view of achieving the above object, those that will come out later, and others, the present invention is related to a structure in which a blow box is fitted in the spaces between the adjacent leading cylinders or rolls in the inverted cylinder group, above the drying cylinder placed below the space. Air blowings can thus be directed out of the nozzle of the blow box into the wedge-shaped nip space opening in the direction of running of the web, which space is defined between the face of the drying cylinder and the run of the web and of the drying wire. A set of air jets out of said blow box promote evaporation of water out of the web, and can be directed at the web running over the leading cylinder.

By means of the blow and air-conditioning device in accordance with the invention, out of the blow box, air blowings are directed into the nip space defined by the face of the drying cylinder placed underneath and by the web and the wire and opening in the direction of running of the web, so that this space becomes slightly pressurized or reaches substantially the same pressure as the environment, whereby transverse air flows are prevented, which attempt to separate the web from the wire and cause instability in the running of the web.

Moreover, in the invention, a field of blowings is utilized, which is applied from the blow box, preferably from both of its sides, towards the runs of the web that pass around the leading cylinders, by means of which filed of blowings evaporation from the web is promoted efficiently and replacement air is introduced into the intermediate spaces between the drying cylinders and the leading cylinders.

DETAILED DESCRIPTION OF THE PREFERRED EMBODIMENTS

In a preferred embodiment of the invention, from the side of the blow box opposite to the above blowings, blowings are applied towards the leading cylinder at the inlet side of the web, in the direction opposite to the direction of running of the web, by means of which blowings the induction air into the nip, which is placed between the web and the cylinder face and closed in the direction of running of the web, is limited, whereby the positive pressure produced in this nip and the transverse air flows arising from said pressure and producing instability are reduced.

In a preferred embodiment of the invention, in connection with the blow box, depending on its construction, various air jets are employed, by whose means the blow box is kept free from paper broke.

In a preferred embodiment of the invention, in the blow box, a pipe or pipes of compressed air is/are integrated, by whose means paper broke can be removed from the spaces between the blow box and the cylinders.

The invention is applied preferably in all inverted wire groups provided with single-wire draw in a drying section, for example in every leading-cylinder gap in said inverted groups.

BRIEF DESCRIPTION OF THE DRAWINGS

The following drawings are illustrative of embodiments of the invention and are not meant to limit the scope of the invention as encompassed by the claims.

DETAILED DESCRIPTION

Figure 1:
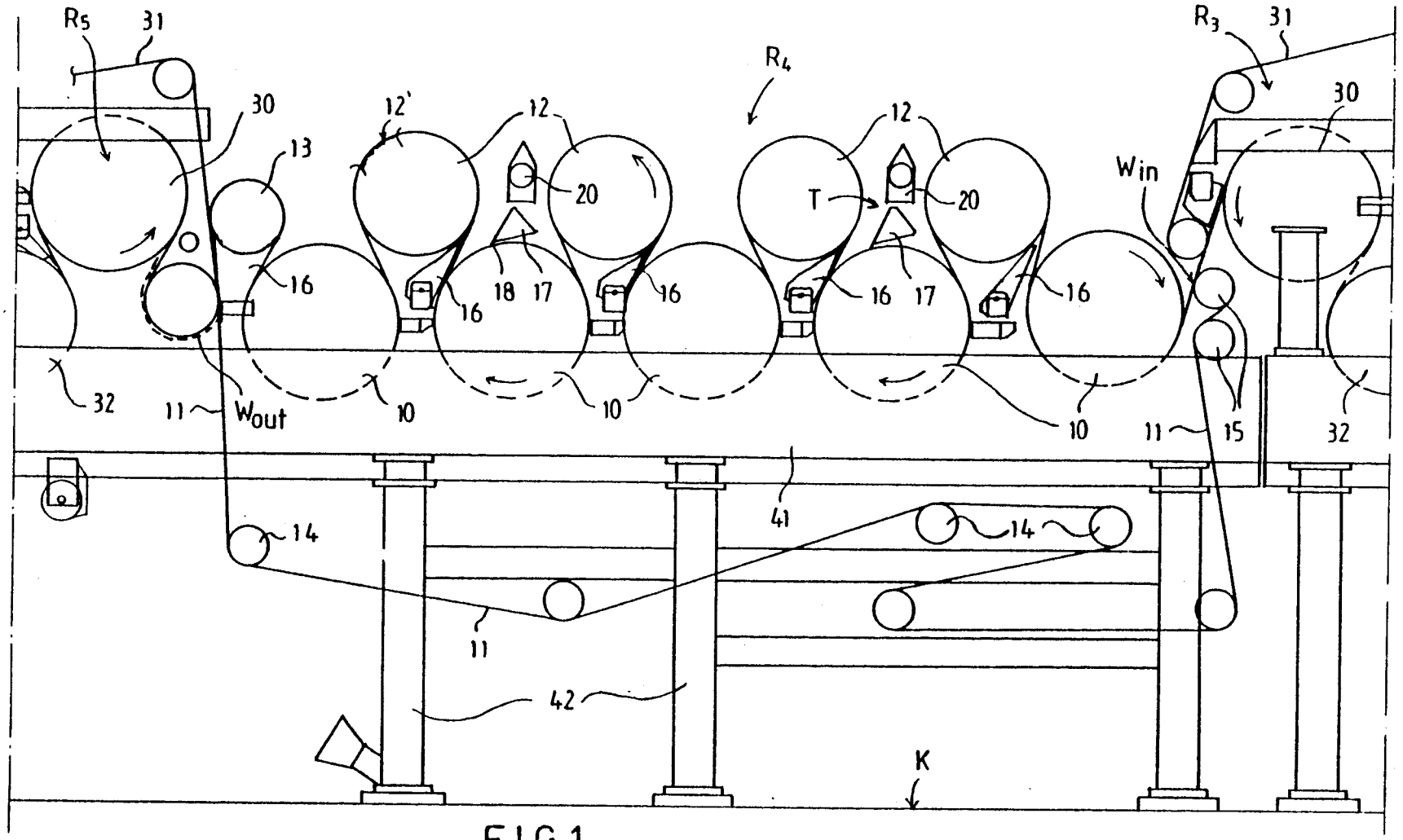
FIG. 1 is a schematic side view of an inverted cylinder group in the drying section of a paper machine in which an air-conditioning device in accordance with the invention is applied.

FIG. 1 shows the first inverted cylinder group $R_4$ in a drying section of a paper machine, in which cylinder group the steam-heated cylinders 10, against which the web W to be dried reaches direct contact, are placed in the lower row and the leading cylinders 12, for example cylinder provided with a perforated mantle 12', are placed in the upper row. In the inverted group $R_4$, a single-wire draw is employed so that the drying wire 11, which is guided by the guide rolls 14, carries the web W to be dried meandering over the cylinders 10 and 12. The web W is brought into the group $R_4$ from the preceding, "normal" cylinder group, which is provided with single-wire draw, and transferred at the proximity of the wire 11 guide rolls 15 as the draw $W_{in}$ onto the drying wire 11. After the inverted group $R_4$ the web $W_{out}$ is transferred after the guide roll 13 into the following "normal" group $R_5$, onto its drying wire 31, which carries out the single-wire draw.

The group $R_3$ that precedes the inverted group $R_4$ is a so-called "normal" drying group, in which the drying cylinder 30 are in the upper row and the leading cylinders 32 in the lower row. The group $R_3$, is, for example, the third wire group in the drying section, and it is preceded by two corresponding "normal" groups provided with single-wire draw. The first cylinder 10 in the inverted group $R_4$ is, for example, the 22nd drying cylinder in the drying section. The inverted group $R_4$ is followed by the group $R_5$ provided with single-wire draw, which is followed by an inverted group, and the last group is a "normal" group, in which the heated drying cylinders are placed in the upper row.

The cylinders 10;30 in the drying section are steam-heated, smooth-faced drying cylinders, with which the web W to be dried reaches direct contact as pressed by the drying wire 11;31. The leading cylinders 12,32 are preferably suction cylinders provided with a perforated mantle With a grooved outer face 12'. A more detailed exemplifying embodiment of the construction of such suction rolls are described, e.g., in the assignee's FI Pat. Appl. No. 881106, corresponding to U.S. Pat. No. 5,022,163, herein incorporated by reference.

By means of the negative pressure effective in the grooved face of the leading cylinders 12,32, the web W is kept reliably on the face of the drying wire 11,31 as it runs over the leading cylinders 12,32 at the side of the outside curve on a sector larger than 180°.

FIG. 1 is also a schematic and partial illustration of the frame constructions 40 of the drying section, which include the foundation constructions 41 in the paper machine hall and the beam constructions 42 in the basement space, said beam constructions being supported on the basement floor constructions K.

According to FIG. 1, in the spaces between the leading cylinders in the inverted group $R_4$, above the doctors 17, blow boxes 20 in accordance with the invention are provided, whose construction and operation will be described in more detail in the following with reference to the exemplifying embodiments in FIGS. 2 and 3.

To begin with, certain important features of the construction and the operation of the blow boxes 20 in the air-conditioning devices shown in FIGS. 2 and will be described. The blow box 20 comprises a box construction provided with closed ends **29*a* and extending across the entire width of the paper web W in the transverse direction. One end 29*a* of the blow box 20 communicates with an air pipe (not shown), through which dry air of suitable temperature is introduced into the blow box 21, by means of which air the spaces T between adjacent leading cylinders 12 and above the free face 10' of the drying cylinder 10 are air-conditioned. In these spaces T, doctors 17 are fitted, whose blade 18 keeps the smooth faces 10' of the cylinders 10** clean.

In FIG. 1, in the downwards open spaces between the drying cylinders 10, blow boxes 16 are shown, which close the inlet nips, which are placed between the leading cylinders 12 and the drying wire 11 and which are closed in the direction of running of the web, and eject air out of said nips so that a pressure that would disturb the support contact between the web and the drying wire 11 is not formed in said nips. Corresponding blow boxes are also employed in the "normal" groups $R_3$,$R_5$.

As was stated above previously, the inlet nips N+ at the spaces T which are defined by the drying wire 11 and the web W and by the cylinder 10 face 10' and which are closed in the direction of running of the web tend to be pressurized to some extent, and the corresponding outlet nips N− tend to be subjected to negative pressure because of the boundary-layer flows induced by the mobile faces.

The negative pressure at an outlet nip N− is emphasized further by the air flows taking place upwards from the spaces T by the chimney effect, whereas corresponding flows do not occur in the "normal" groups $R_3$,$R_5$, in which the cylinders 30 form a "ceiling" above. Owing to the negative pressure at the outlet nips N−, replacement air tends to flow into them from the sides of the machine, which air tends to penetrate between the wire 11 and the paper W and to detach the edge of the paper W, which is a considerable drawback.

This drawback is eliminated and the drying of the web W intensified by the blow boxes 20 in accordance with the invention, which boxes are placed, as is shown in FIG. 1, in every second intermediate space T between the leading cylinders 12 in the inverted group $R_4$, which spaces are provided with doctors.

The blow boxes 20 include a first nozzle slot 21, which blows a first air flow $F_1$ in the direction opposite to the running direction of the web W running at its proximity. By means of the air flow $F_1$, the air flow induced by the wire 10 and by the web W into the inlet nip N+ is reduced, and hereby the difference in pressure between this nip N+ and its environment is reduced. From a second nozzle slot 22, which is placed at the opposite side of the blow box 20, a second air flow $F_2$ is blown into the nip N− with negative pressure. The blowings $F_2$ are directed into the nip N− as guided by the plane face 17*a* of the doctor beam 17 placed at the side of the blade 18 and by the blade 18.

By means of the blowing F, the nip N−, which would otherwise be subjected to negative pressure, can be subjected to positive pressure or brought substantially to the same pressure level as its environment, whereby the drawbacks discussed above are avoided.

In order to promote the evaporation of water from the paper web and to remove moist air out of the intermediate spaces T, the blow box 20 is provided with nozzle perforations 23 or with corresponding nozzle slots, through which air flows $F_3$ are blown towards the web W running at the proximity. By means of the flow $F_2$, the drying of the web W is promoted substantially. The air supplied by means of all of the various blowings $F_1$, $F_2$ and $F_3$ operates, at the same time, as replacement air in the drying area concerned.

One of the problems in the inverted groups $R_4$ is how to keep the intermediate spaces T clean from paper broke in connection with breaks. For handling of paper broke, compressed-air pipes 27 have been integrated in the blow boxes 20, through which pipes compressed air is blown towards the driving side of the machine to remove the paper broke out of the spaces T.

Figure 4:
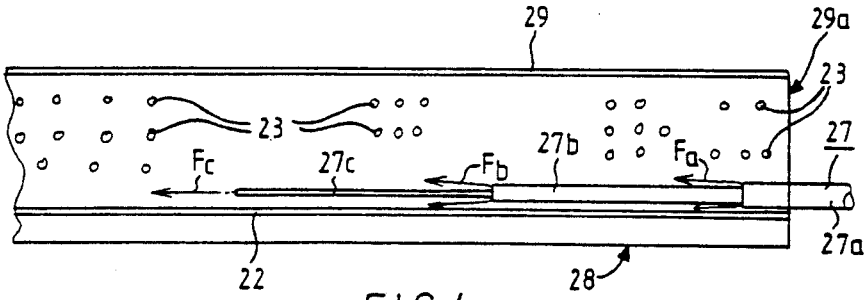
FIG. 4 is a transverse partial sectional view along the line IV—IV in FIG. 3.

FIG. 4 shows the construction of a compressed-air pipe 27 in more detail. The compressed-air pipe consists of coaxial pipes 27*a*, 27*b* and 27*c* placed one inside the other. Out of the intermediate space between the pipes 27*a* and 27*b*, sharp compressed-air jets $F_2$ are blown towards the driving side, and out of the intermediate space between the pipes 27*b* and 27*c*, jets $F_b$ are blown from a point different from the jets $F_2$.

Figure 2:
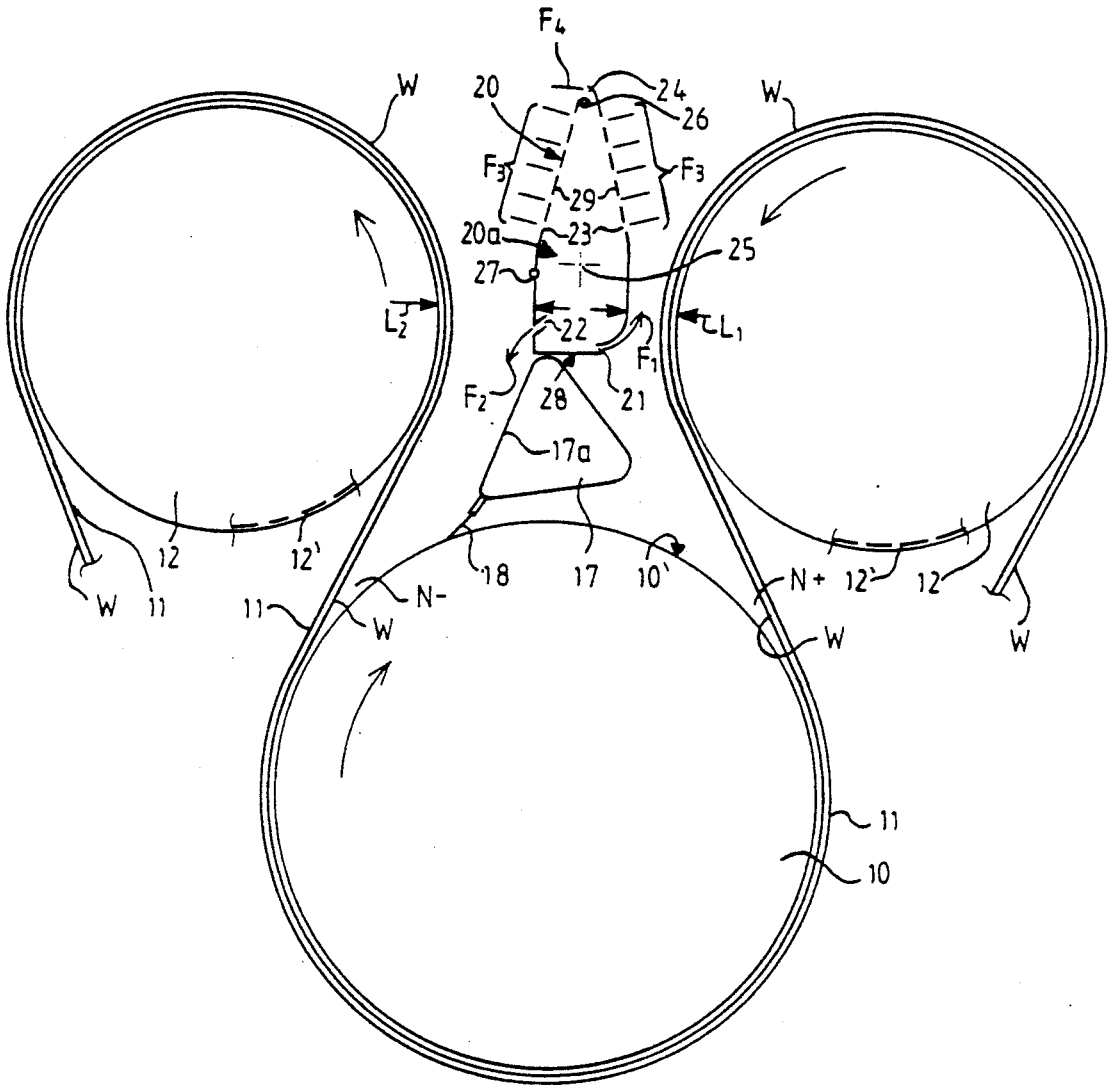
FIG. 2 is a vertical sectional view in the machine direction of a first embodiment of an air-conditioning device in accordance with the invention.
Figure 3:
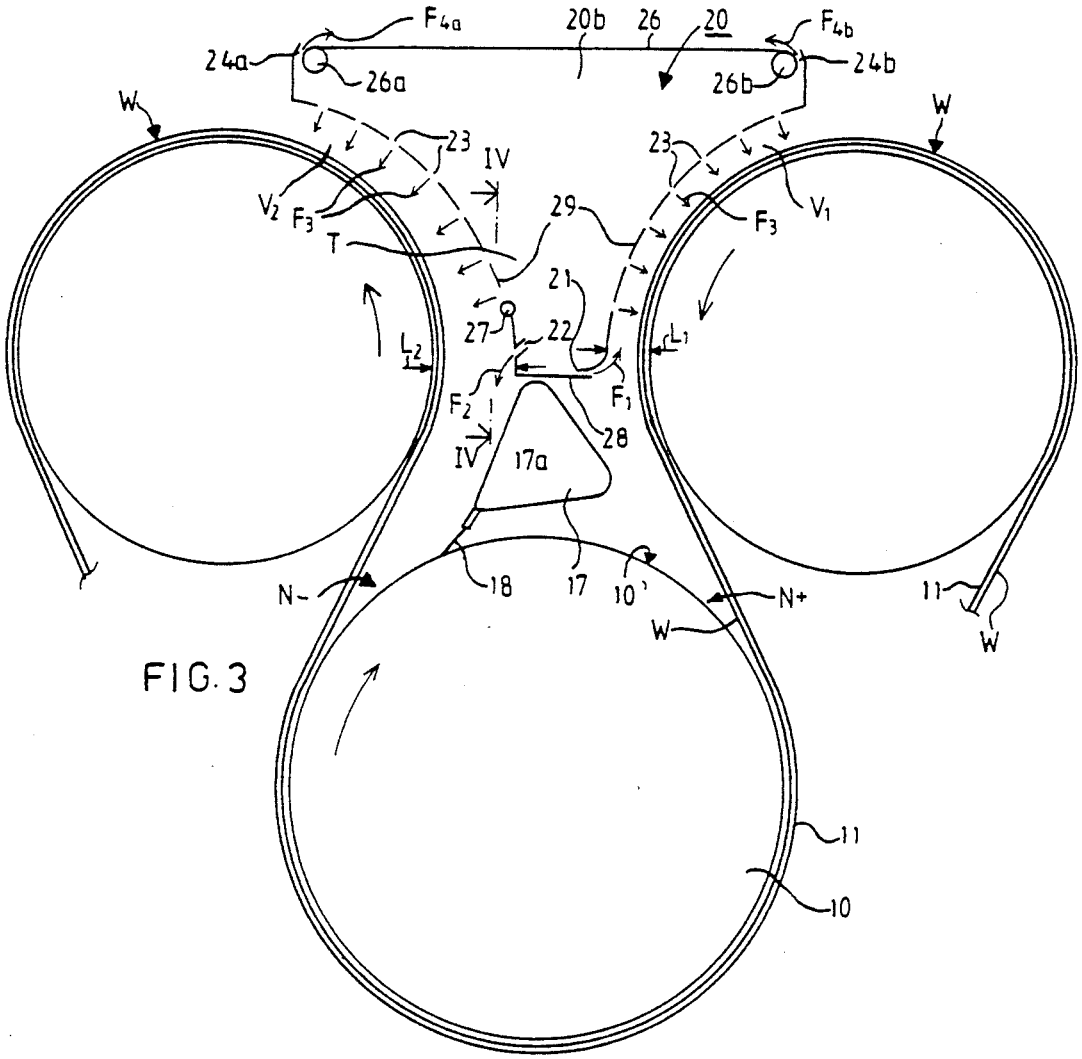
FIG. 3 is an illustration corresponding to FIG. 2 of a second embodiment of the invention.

Out of the end of the innermost pipe part 27C, which extends further, the jets $F_c$ are blown. the compressed-air pipes 27 are not always necessary, and they maybe placed in a way different from that shown in FIGS. 2 and 3.

It is a further common feature of the blow boxes 20 as shown in FIGS. 3 and 4 that the plane front wall of the doctor beam 17 and the doctor blade 18 with its holder are used as a guide face for the second blowings $F_2$ when these are directed at the nip N−.

In the following, the features of construction of the devices as shown in FIGS. 2 and 3 will be described that differ from one another.

According to FIG. 2, the blow box is attached by the points 25, e.g., by means of axle journals both at the driving side and at the operating side of the machine, preferably as pivotal and possibly also so that its position can be adjusted in view of optimization of the operation. The blow box 20 comprises a plane lower wall 28, in connection with which there is a first nozzle slot 21 and, at its proximity, a second nozzle slot 22. The top part of the blow box 20 consists of walls 29 that approach each other towards the top, said walls being provided with nozzle openings 23 for the blowings $F_3$. At the top end of the blow box 20, at the pipe part 26, there is a nozzle opening 24, from which a cleaning blowing $F_4$ is applied to the device. The first nozzle slot 21 is provided with an extension consisting of a curved coanda face 21*a*, which turns and directs the flow $F_1$ and terminates in a planar wall, whose distance $L_1$ from the adjoining wire 11 and web W is substantially shorter than the corresponding distance $L_2$ of the wall at the side of the second nozzle 22.

FIG. 3 shows a second exemplifying embodiment of a blow box 20, in which the blow box 20 becomes narrower towards the bottom, comprising curved wall faces 29 provided with nozzle openings 23. The distance $L_1$ of the wall face 29 that defines the intermediate space $V_1$ at the inlet side of the web W from the web W is substantially invariable, whereas, at the outlet side of the web W, the distance $L_2$ becomes shorter and the intermediate space $V_1$ narrower in the direction of the running of the web. The air jets $F_3$ are applied to the web W with a short ejection length and thereby promote the evaporation from the web W efficiently. The top side of the blow box 20 as shown in FIG. 3 consists of a substantially horizontal plane wall 26, at which, in connection with the pipe parts 26*a* and 26*b* placed at its edges, there are nozzle slots 24*a* and 24*b*, from which the air jets $F_{4a}$ and $F_{4b}$ are blown towards the wall 26 so as to keep the top of the blow box 20 clean.

Blowings applied from the compressed-air pipes 27 are employed exclusively in connection with breaks for removal of broke, whereas the blowings $F_4$ and $F_{4a}$, $F_{5b}$ may be in operation constantly.

Into the interior spaces 20*a*;20*b* in the blow boxes 20, blow air of suitable temperature and humidity is introduced through one end of the box so that the pressure level in the interior of the blow box is preferably in the range of p=from about 500 to about 2000 Pa. The temperature of the blow air is preferably in the range of T=from about 65° to about 120°, and the humidity in the range of X=from about 10 to about 50 g $H_2O$ per kg of dry air.

The examples provided above are not meant to be exclusive. Many other variations of the present invention would be obvious to those skilled in the art, and are contemplated to be within the scope of the appended claims.

What is claimed is:

1. A drying section of a paper machine, comprising an inverted cylinder group arrangement comprising a lower row of heated drying cylinders, and a corresponding row of leading cylinders or rolls placed above and in gaps between said lower row of drying cylinders, said inverted cylinder group being provided with a single-wire draw carrying a web to be dried in a meandering manner over said drying cylinders and said leading cylinders or rolls, so that said heated drying cylinders are placed outside the loop of the drying wire and said leading cylinders in said inverted groups are placed inside the drying-wire loop, said inverted cylinder group arrangement defining spaces located between adjacent ones of said leading cylinders or rolls and above an associated one of said drying cylinders, a blow box fitted above said associated drying cylinder, said blow box having a nozzle and a plurality of nozzle perforations separate from said nozzle, said nozzle structured and arranged to direct air blowings into an outlet nip space opening in the direction of running of the web and defined between a face of at least one of said drying cylinders and the run of the web and the drying wire, said plurality of nozzle perforations structured and arranged by direct jets of air at the web running over said leading cylinders or rolls to promote evaporation of water out of the web.

2. The drying section of claim 1, wherein said blow box further comprises a second nozzle through which an air jet is applied at an inlet nip space closed in the direction of running of the web and defined between a face of said at least one of said drying cylinders and the run of the web and the drying wire in a direction contrary to the direction of running of the web, by means of which jet the pressure level is lowered in said inlet nip space.

3. The drying section of claim 2, further comprising a doctor beam fitted below said blow box, said doctor beam including a wall located at a side of said outlet nip space, said nozzle of said blow box directing air jets toward the bottom of said outlet nip space by means of said wall of said doctor beam.

4. The drying section of claim 3, wherein said blow box includes an upper section having opposing walls which approach each other towards a top of said blow box, said plurality of nozzle perforations in said blow box being located in said opposing walls.

5. The drying section of claim 2, wherein a top end of said blow box is provided with a third nozzle through which an air jet is applied in order to keep said blow box clean.

6. The drying section of claim 1, wherein said blow box comprises opposing curved wall parts which approach each other towards a bottom of said blow box, said curved walls being provided with said plurality of nozzle perforations or with corresponding nozzle slots, said curved walls having a shape adapted to that of said adjacent ones of said leading cylinders placed at their proximity, and that, through said plurality of nozzle perforations, sets of air jets which promote evaporation can be applied to the web.

7. The drying section of claim 6, wherein said blow box comprises a substantially planar top wall having opposite edges each in proximity to an adjacent one of said leading cylinders or rolls, said blow box further comprising transverse nozzle slots at both of said edges through which air jets are applied in order to keep said top wall of the blow box clean.

8. The drying section of claim 1, further comprising a substantially planar doctor beam located below said blow box, said blow box being provided with a lower side wall which includes said nozzle, said first nozzle being directed obliquely downwards towards said outlet nip space, a front wall of said doctor beam being located substantially underneath said nozzle and substantially parallel to its blow direction.

9. The drying section of claim 1, further comprising doctors for cleaning a face of said drying cylinders, said doctors located in said spaces below said blow boxes and above said drying cylinders.

10. The drying section of claim 1, wherein said blow boxes are placed in alternate spaces between adjacent ones of said leading cylinders or rolls.

11. The drying section of claim 2, wherein said second nozzle is provided with an extension consisting of a curved coanda face which guides and turns the air jet which is provided through said second nozzle in an upward direction contrary to the running direction of the web running at its proximity.

12. A method for improving a drying section of a paper machine comprising an inverted cylinder group arrangement comprising a lower row of heated drying cylinders, and a corresponding row of leading cylinders or rolls placed above and in gaps between said lower row of drying cylinders, said inverted cylinder group being provided with a single-wire draw carrying a web to be dried in a meandering manner over said drying cylinders and said leading cylinders or rolls, so that said heated drying cylinders are placed outside the loop of the drying wire and said leading cylinders in said inverted group are placed inside the drying-wire loop, and said inverted cylinder group arrangement defines spaces located between adjacent ones of said leading cylinders or rolls and above an associated one of said drying cylinders, the method comprising fitting a blow box above said associated drying cylinder and between adjacent ones of said leading cylinders or rolls, and providing said blow box with nozzle structured and arranged to direct air blowings into an outlet nip space opening in the direction of running of the web and defined between a face of at least one of said drying cylinders and the run of the web and the drying wire, and providing said blow box further with a plurality of nozzle perforations structured and arranged to direct jet of air at the web running over said leading cylinders or rolls to promote evaporation of water out of the web, said plurality of nozzle perforations being separate from said nozzle.

13. The method of claim 12, further comprising providing said blow box with a second nozzle through which an air jet is applied at an inlet nip space closed in the direction of running of the web and defined between a face of said at least one of said drying cylinders and the run of the web and the drying wire in a direction contrary to the direction of running of the web, by means of which jet the pressure level is lowered in said inlet nip space.

14. The method of claim 13, further comprising providing said blow box with a third nozzle slot in proximity to a top wall of said blow box, through which an air jet is applied in order to keep said blow box clean.

* * * * *